United States Patent [19]

Massaglia

[11] Patent Number: 4,630,822

[45] Date of Patent: Dec. 23, 1986

[54] GAME EMPLOYING TOP AND PLATFORM

[75] Inventor: Giovanni Massaglia, Hadden Heights, N.J.

[73] Assignee: Jem Imports, Inc., Hadden Heights, N.J.

[21] Appl. No.: 779,739

[22] Filed: Sep. 24, 1985

[51] Int. Cl.[4] ..... A63D 3/00; A63F 7/00

[52] U.S. Cl. ..... 273/118 A; 273/123 A; 273/1 M

[58] Field of Search ..... 273/118 R, 118 A, 120 R, 273/120 A, 123 R, 123 A, DIG. 24, 11 C

[56] References Cited

U.S. PATENT DOCUMENTS 1,028,467 6/1912 Kaerschke ..... 273/123 R
4,354,682 10/1982 Vcala ..... 273/DIG. 24

FOREIGN PATENT DOCUMENTS 867642 1/1963 Canada ..... 273/123 R
25783 of 1908 United Kingdom ..... 273/123 R

*Primary Examiner*—Richard C. Pinkham
*Assistant Examiner*—Gary Jackson
*Attorney, Agent, or Firm*—Caesar, Rivise, Bernstein, Cohen & Pokotilow, Ltd.

[57] ABSTRACT

A top and platform game having a platform with a plurality of cavities in an upper surface thereof, and a number value specified adjacent each of the cavities. A plurality of spherical members are positionable on the platform, and a top adapted to be spun on the platform includes surfaces for engaging the spherical members and casting them about the platform when the top is spun, at least one of the spherical members being different from the other spherical members. A method of playing the game in which a point value is assigned to the different spherical member by multiplying the number value adjacent the cavity into which it is cast by a factor other than one, and preferably by a factor greater than one.

2 Claims, 5 Drawing Figures

| SPIN NO. | PLAYER | PLAYER | PLAYER | PLAYER |
|---|---|---|---|---|
| 1 | | | | |
| 2 | | | | |
| 3 | | | | |
| 4 | | | | |
| SHORTEST SPIN | | | | |
| 6 | | | | |
| 7 | | | | |
| 8 | | | | |
| 9 | | | | |
| LONGEST SPIN | | | | |
| TOTAL SCORE | | | | |

40

GAME EMPLOYING TOP AND PLATFORM

BACKGROUND OF THE INVENTION

This invention relates generally to a game, and more specifically to a unique top and platform game.

A top and platform game which has been played for years in various parts of Europe includes a platform with a central section or trough having a concave upper surface in which a plurality of cavities are provided. In addition, a plurality of peripheral cavities are provided outside the region of the central trough. A plurality of identical spherical members are positioned in the trough, and a top is spun or rotated in the trough to engage the spherical members and cast them toward the cavities. A number is positioned adjacent each of the cavities, and this number sets forth the point value for each spherical member that is cast into the cavity.

Each player totals his or her score by adding the values adjacent each cavity into which a spherical member has been cast. If more than one sperical member is cast into a particular cavity, then the value of that cavity is multiplied by the number of members in it.

At the outset the players can decide how many spins of the top will constitute a game, and the winner of the game will be the one having the highest number of points after each player has had the agreed upon number of spins.

Although the above-described game has enjoyed some popularity, improvements to enhance the excitement level of playing the game are desirable.

OBJECTS OF THE INVENTION

It is an object of this invention to provide a top and platform game which is more exciting to play than the heretofore described prior art game.

It is another object of this invention to provide a top and platform game wherein the players' scores are capable of more dramatic changes than when playing the heretofore described prior art game.

It is a further object of this invention to provide a top and platform game wherein the range of scores that each player is capable of obtaining is greater than the range of scores attainable when playing the heretofore described prior art game.

SUMMARY OF THE INVENTION

The above and other objects of this invention are achieved in a top and platform game including a platform with a plurality of cavities in an upper surface thereof, with each cavity having a numerical value specified adjacent to it. A plurality of spherical members are adapted to be positioned on the upper surface of the platform, inwardly of the cavities, and at least one of these spherical members is different from the remaining members. The top has a lower surface for engaging the platform in the vicinity of the spherical members. The top further includes surfaces adjacent its lower surface for engaging the spherical members when the top is spun to thereby cast, or drive, the spherical members about the platform until they are received in a cavity, or until the top stops spinning.

In accordance with the preferred embodiment of this invention one of the spherical members is different from the remaining spherical members, and the difference is identified with a separate indicating means. In the most preferred embodiment all but one of the spherical members has magnetic properties, and the indicating means includes a magnetic section for engaging all of the spherical members except the one that does not have magnetic properties.

In accordance with the preferred method of playing the game in accordance with this invention the spherical member that is different from the rest is assigned a point value equal to the numerical value of the cavity into which is cast, multiplied by a factor other than one (e.g., two times the numerical value, three times the numerical value, etc.). The remaining spherical members are assigned a point value equal to the numerical value of the cavity into which they are cast.

By assigning a point value to one of the spherical members that is greater than the numerical value of the cavity into which it is cast the players' scores can undergo more dramatic changes than in playing the heretofore described prior art game, wherein all the spherical members are identical, and each is assigned a point value equal to the numerical value of the cavity into which it is cast. The possibility that a more dramatic change in a player's score can occur in accordance with this invention enhances the excitement level of playing the game.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 1 is a isometric view of a part of the top and platform game of this invention, showing the position of spherical members after they have been cast into various cavities in the platform;

DESCRIPTION OF THE PREFERRED EMBODIMENT OF THE INVENTION

Figure 5:
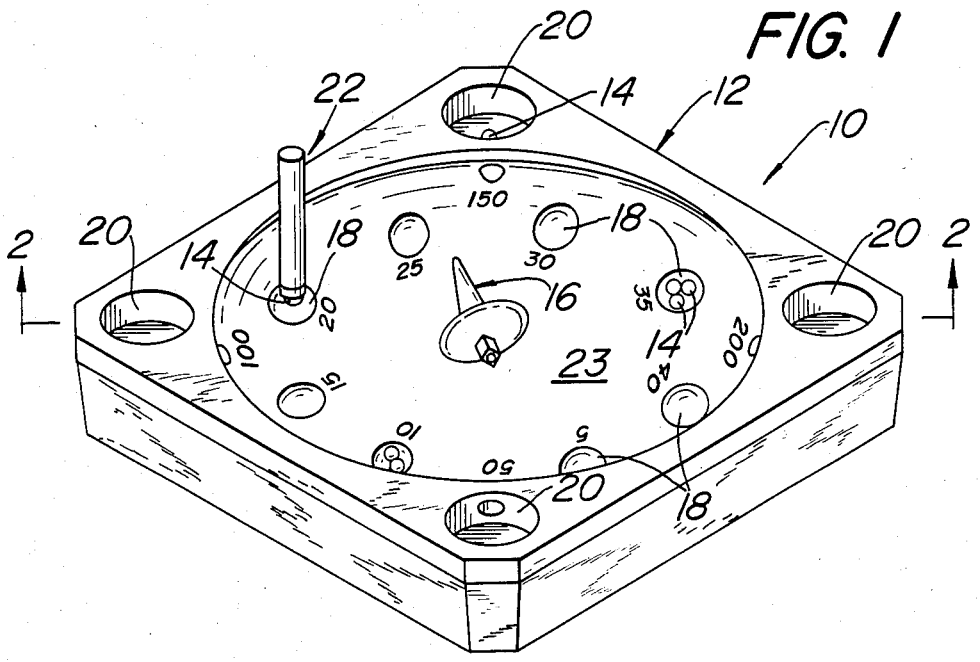
FIG. 5 is a plan view of a typical score sheet which can be employed in playing the game.

Referring now in greater detail to the various figures of the drawings wherein like reference characters refer to like parts, a top and platform game embodying the present invention is generally shown at 10 in FIG. 1. The device 10 basically comprises a platform 12, a plurality of spherical balls 14, at least one of which is different from the remaining balls, a top 16 adapted to be spun on the platform for casting or driving the spherical balls 14 into cavities 18 and 20 formed in the platform 12 and an indicating device 22 for identifying the spherical ball(s) that that is (are) different from the remaining balls.

Figure 2:
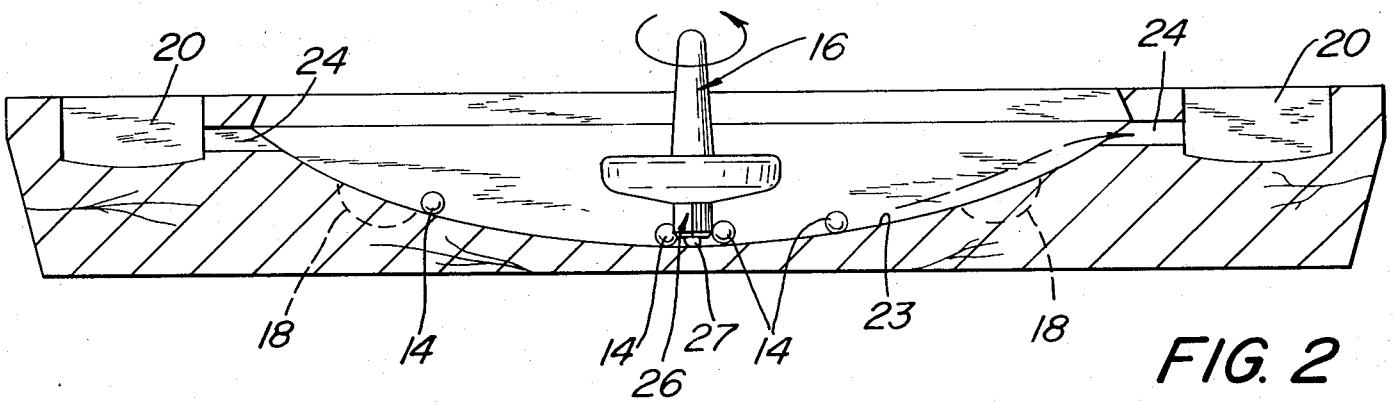
FIG. 2 is a sectional view taken along lines 2—2 of FIG. 1.

As can be seen most clearly in FIGS. 1 and 2, the platform 12 includes a central section 23 in the form of a concave trough. The plurality of cavities 18, eight being illustrated in FIG. 1, are located in a circle about the outer periphery of the trough 23. That is, the locus of the center of the cavities is a circle having its center located in the middle of the trough.

The cavities 20 are located radially beyond the cavities 18, and in the preferred embodiment are located at the corners of the platform 12. An elongate passage 24 interconnects the trough 23 with each of the peripheral cavities 20, so as to permit the spherical balls 14 to be cast or driven into the these peripheral cavities, in a manner to be described hereinafter.

Figure 3:
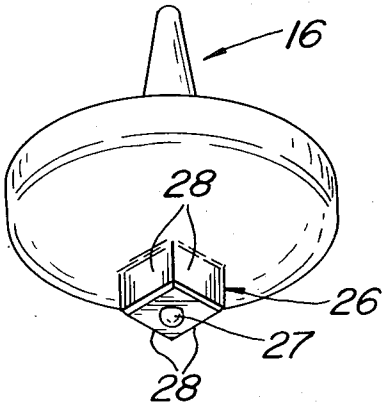
FIG. 3 is an isometric view of the top employed in the game.

Referring specifically to FIG. 3, the top 16 of this invention has a lower, ball-engaging section 26, the bottom surface of which includes a spherical section 27 adapted to be positioned on the trough 23, and about which the top 16 is adapted to be spun, as can be seen best in FIG. 2. The ball-engaging section 26 includes a plurality of flat surfaces 28 extending upwardly from the bottom surface for engaging the spherical balls 14 and driving or casting them about the trough as the top 16 is spinning. While the top is spinning the balls 14 can be repeatedly hit, more than once, by one or more of the surfaces 28 to eventually drive most, if not all, of the spherical balls into one or more of the cavities 16 and 18.

It should be noted that the cavities 18, which are positioned closer to the center of the trough 23 than the cavities 20, have lower numerical values than the cavities 20. The reason for this is that the spherical balls 14 have a greater tendency to be captured in the cavities 18 adjacent the periphery of the trough, than in the peripheral cavities 20, which are spaced radially beyond the cavities 18. Thus, since there is a lower probability that the spherical balls 14 will enter the peripheral cavities 20, a player who actually casts a spherical ball into a peripheral cavity is rewarded with a higher score.

In accordance with an improvement of this invention at least one of the spherical balls 14 is different from the other spherical balls. Most perferably, all but one of the spherical balls 14 are magnetic, and therefore are capable of being attracted by a magnet. The remaining ball is non-magnetic.

Figure 4:
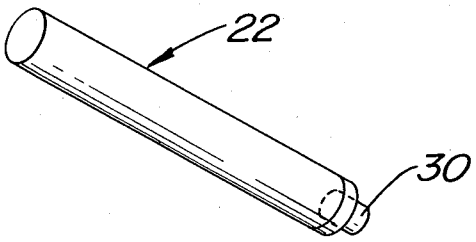
FIG. 4 is an isometric view of an indicator having a magnetic tip for use in identifying spherical members having magnetic properties.

Referring to FIGS. 1 and 4, in the preferred embodiment of this invention the indicating device 22 is a pick-up device having a magnetic tip 30 at its free end. Thus, after a player has cast the spherical balls 14 into one or more of the cavities 18 and 20 by spinning the top 16, the pick-up device 22 is employed to determine which spherical balls 14 are magnetic, and thereby also identifying the ball that is non-magnetic.

In accordance with a preferred method of playing the game the magnetic spherical balls each will be assigned a point value equal to the value of the cavity into which it has been cast, and the non-magnetic ball will be assigned a higher point value than the numerical value of the cavity into which it has been cast, e.g., twice the value of the cavity. By providing an opportunity for such a higher point value to be achieved, an additional element of uncertainty and excitement is introduced into the game, which is not otherwise possible when all of the spherical members are the same, and the point value assigned to each spherical ball is exactly equal to the numerical value of the cavity into which it is directed.

Referring to FIG. 5, a score sheet 40 is shown, and in the illustrated embodiment is set up for a game consisting of ten spins per player, and for up to four players. Of course the score card can be enlarged to permit more than four players to play the game, or to accommodate more than ten (10) spins per game.

In playing the game the players alternate spins. At the end of each player's spin he or she will use the pick-up device 22 to pick up each of the spherical balls 14 which are magnetic. As each magnetic ball is picked up it will be assigned a point value equal to the numerical value of the cavity into which it was cast. The non-magnetic ball (which is the one that will not be attracted to the tip 30 of the pick-up device 22) will be assigned a point value equal to the numerical value of the cavity into which it was cast, multiplied by a factor other than one, and more preferably multiplied by a factor of two. At the end of each spin the player will enter the total points he has obtained on the score sheet 40, adjacent the appropriate spin number.

If one or more of the balls 14 are cast or driven off the platform it is permissible to retrieve the ball and drop it back onto the platform while the top is spinning, and thereby possibly score points with that ball. Of course, if the players wish they can vary this rule, and not permit the ball to be retrieved and used.

At spin no. 5 each of the players times the duration of his or her spin of the top. This can be accomplished by using a conventional stopwatch, or a pen-watch, either of which can be included as part of the game 10. The player with the shortest time of spin will be penalized by forfeiting spin no. 6. This feature, by which a player loses a turn, introduces a further element of uncertainity and excitement into the game. However, the player who loses a turn at spin no. 5 still will have an opportunity to recoup his lost turn at spin no. 10, which is the last spin of the game. In particular, at spin no. 10 each of the players again time the duration of his or her spin, but in this instance, the player with the longest time of spin will be rewarded with a bonus spin.

The preferred method of playing the game 10 in accordance with this invention, wherein one of the spherical balls will be assigned a higher point value than the numerical value of the cavity into which is directed, and further wherein the possibility exists for each player to either lose a turn or win a bonus turn, introduces elements of uncertainity and excitement into the game which have not been achieved in the prior art versions of this game.

Of course, the players are free to modify and adjust the rules in accordance with their mutual understanding and agreement. However, the preferred method herein clearly introduces elements of uncertainity and excitement into the game which have heretofore not been achieved.

In the most preferred embodiment of this invention all but one of the spherical balls 14 are magnetic, and the pick-up device 22 is employed to first pick out all of the magnetic balls, which only are assigned a point value equal to that of the cavity into which they are cast. The remaining non-magnetic ball, which is assigned a higher value than the numerical value of the cavity into which it is cast, will then be left in the cavity for all to observe. This also introduces an element of suspense into the game since the players will only know which of the balls 14 is to be assigned a multiple point value after all of the remaining balls have first been identified.

In accordance with this invention it is preferred that the ball 14 which differs from the remaining balls only be identifiable with the use of an indicating device, e.g., device 22, so that the players will not know which cavity that ball was cast into merely by observing the balls at the end of the spin. In other words, the players will experience the added suspense of waiting until the indicating device is used to determine which ball is to be assigned a point value different from the numerical value of the cavity into which it was cast.

Various modifications can be made in accordances with the broadest aspects of this invention. For example, it is possible to design the game so that all but one of the spherical balls 14 are non-magnetic. In this arrangement the pick-up device 22 would only be used to pick out the spherical ball which is intended to be assigned a different point value than the numerical value of the cavity into which it is cast. However, although within the broadest aspects of this invention, it is less preferred to construct the spherical balls so that only one of them is magnetic. The reason for this is that it removes the element of suspense of requiring all of the other balls to first be identified before the players know which ball will be assigned a point value equal to a multiple of the numerical value of the cavity into which it was cast.

Without further elaboration, the foregoing will so fully illustrate my invention, that others may, by applying current or future knowledge, adopt the same for use under various conditions of service.

I claim:

1. A top and platform game comprising a platform having a plurality of cavities in an upper surface thereof and a numerical value specified adjacent each of said cavities; a plurality of spherical members positionable on said platform; a spinable top having a lower surface for engaging the platform when the top is spun thereon, said top having surface means for engaging said spherical members about said platform; one of said spherical members having a different magnetic property from the other spherical members and indicator means for identifying said different magnetic properties.

2. A top and platform of claim 1 wherein said one of said spherical members is nonmagnetic and the remaining spherical members are magnetic, and said indicator means includes a magnetic section for engaging the magnetic spherical member but not said non-magnetic spherical members.

* * * * *